US010207492B2

(12) United States Patent
Muraoka

(10) Patent No.: US 10,207,492 B2
(45) Date of Patent: Feb. 19, 2019

(54) METHOD OF MANUFACTURING PRINTING BLANKET

(71) Applicant: SHUHOU CO., LTD., Fukui (JP)

(72) Inventor: Kouji Muraoka, Fukui (JP)

(73) Assignee: SHUHOU CO., LTD., Fukui-Shi, Fukui (JP)

( * ) Notice: Subject to any disclaimer, the term of this patent is extended or adjusted under 35 U.S.C. 154(b) by 244 days.

(21) Appl. No.: 15/314,706

(22) PCT Filed: Dec. 18, 2015

(86) PCT No.: PCT/JP2015/085588
§ 371 (c)(1),
(2) Date: Nov. 29, 2016

(87) PCT Pub. No.: WO2017/104087
PCT Pub. Date: Jun. 22, 2017

(65) Prior Publication Data

US 2018/0222177 A1 Aug. 9, 2018

(51) Int. Cl.
*B41N 10/00* (2006.01)
*B41N 10/02* (2006.01)
(Continued)

(52) U.S. Cl.
CPC ..... *B41F 17/34* (2013.01); *B41F 30/00* (2013.01); *B41N 10/00* (2013.01); *B41N 10/02* (2013.01); *B41N 2210/02* (2013.01)

(58) Field of Classification Search
CPC ..... B41N 10/00; B41N 10/02; B41N 10/04; B41N 10/06; B41N 2210/02; B41F 17/34; B41F 30/00; B41F 17/001
(Continued)

(56) References Cited

U.S. PATENT DOCUMENTS

2010/0193112 A1 8/2010 Bovet et al.
2012/0031289 A1* 2/2012 Cheng ..... B41F 17/001 101/333
(Continued)

FOREIGN PATENT DOCUMENTS

CN 102781679 A 11/2012
JP 62-132691 A 6/1987
(Continued)

OTHER PUBLICATIONS

Taiwanese Office Action dated Oct. 17, 2017 for Taiwanese Application No. 105138835.
(Continued)

*Primary Examiner* — Leslie J Evanisko
(74) *Attorney, Agent, or Firm* — Ladas & Parry LLP

(57) ABSTRACT

A method of manufacturing a printing blanket without wrinkles in a sheet is provided, the printing blanket including an elastic body and a sheet bonded to a surface thereof, the method being configured to press a surface of the sheet against a surface to be printed, to perform printing, and including: fixing the sheet at a periphery of a region of the sheet to be bonded to the elastic body; mounting the elastic body to oppose a bonding surface of the elastic body to a bonding surface of the fixed sheet; applying an adhesive to at least one of the bonding surface of the sheet or the bonding surface of the elastic body; and pressing the bonding surface of the sheet and the bonding surface of the elastic body against each other to bring the sheet into close contact with the elastic body through intermediation of the adhesive while stretching the sheet along the surface of the elastic body.

6 Claims, 3 Drawing Sheets

(51) Int. Cl.
*B41F 17/34* (2006.01)
*B41F 30/00* (2006.01)

(58) Field of Classification Search
USPC ..... 101/217
See application file for complete search history.

(56) References Cited

U.S. PATENT DOCUMENTS

2012/0222573 A1* 9/2012 Wu ..... B41F 17/001 101/333
2012/0318154 A1 12/2012 Muraoka

FOREIGN PATENT DOCUMENTS

JP 2011-183604 A 9/2011
JP 2011-224894 A 11/2011
JP 5398627 B2 11/2013
KR 10-1509605 B1 4/2015
TW 201536568 A 10/2015

OTHER PUBLICATIONS

Espacenet English abstract of CN 102781679 A.
Espacenet English abstract of TW 201536568 A.
International Search Report (ISR) and Written Opinion (WO) dated Mar. 1, 2016 for International Application No. PCT/JP2015/085588.
J-PlatPat English abstract of JP 5398627 B2.
J-PlatPat English abstract of JP 2011-224894 A.
J-PlatPat English abstract of JP 2011-183604 A.
J-PlatPat English abstract of JP 62-132691 A.
Korean Office Action dated Sep. 12, 2018 issued in connection with corresponding Korean Patent Application No. 10-2016-7034729 with English translation.
English (machine) translation of KR 10-1509605 B1.

* cited by examiner

METHOD OF MANUFACTURING PRINTING BLANKET

RELATED APPLICATION

This application is an application under 35 U.S.C. 371 of International Application No. PCT/JP2015/085588 filed on Dec. 18, 2015, the entire contents of which are incorporated herein by reference.

TECHNICAL FIELD

The present invention relates to a method of manufacturing a printing blanket, and more particularly, to a method of manufacturing a printing blanket, which is suitably applied to blanket printing involving transferring transferred ink onto a surface to be printed.

BACKGROUND ART

Hitherto, in blanket printing, a printing surface of a printing blanket (corresponding to a transferring blanket) is pressed against a printing master plate (corresponding to a printing plate) so that ink, which is applied onto the printing master plate in a pattern corresponding to a printing pattern, is transferred onto the printing blanket. Subsequently, the printing surface of the printing blanket, onto which the ink is transferred, is pressed against a surface to be printed so that the transferred ink is transferred onto the surface to be printed. In this manner, the printing pattern is printed on the surface to be printed.

For example, in the related art, the printing blanket is an elastic body, such as elastic (flexible) silicon rubber, in which a silicon oil is mixed, and is formed into a substantially hemispherical shape (bullet shape) or a substantially semi-cylindrical shape (bullet shape in cross section). The printing blanket is pressed against the printing master plate having a flat surface shape and the surface to be printed having a curved surface shape, to thereby transfer the ink onto the surface to be printed. Therefore, in particular, a distal end of the printing blanket (lowermost point or lowermost line) and a periphery of the distal end are deteriorated or damaged due to damage caused by the operation of pressing the printing blanket against the printing master plate, a protrusion of the surface to be printed when the printing blanket is pressed against the printing surface, or other adverse effects. Due to the deterioration of or the damage to the limited region of the printing blanket, the printing blanket cannot be used.

Further, in order to fit the printing blanket in conformity with the surface to be printed, it is necessary to form the printing blanket softly (corresponding to formation of the printing blanket so as to have a small elastic modulus and to be easily elastically deformed). With this, when the printing surface of the printing blanket is pressed against the printing master plate so that the printing blanket is deformed, the silicon oil mixed in the printing blanket seeps out to a surface of the printing blanket. At this time, the ink applied to the printing master plate is not easily transferred from the printing master plate onto the printing blanket so that the printing pattern printed on the surface to be printed may be faded or blurred.

Further, through repetition of the printing, the ink or the silicon oil is excessively deposited on the printing master plate, thereby staining the printing master plate. The printing blanket is pressed against the stained printing master plate, thereby transferring the stains onto the printing blanket. The printing is performed using the stained printing blanket, thereby staining the printing pattern printed on the surface to be printed.

Further, when the printing is performed using the printing blanket, the silicon oil component seeping out from the elastic body of the printing blanket adheres to the surface to be printed. When the surface to be printed with the silicon oil component adhering thereto is to be coated, the coating is repelled by the silicon oil component. With this, a desired coating layer is not formed on the surface to be printed.

Meanwhile, when the content of the silicon oil in the silicon rubber forming the printing blanket is reduced to obtain a harder silicon rubber, it is difficult to perform the printing on a curved surface in a wide region. Therefore, the printing is limited in a small region so that the designability may be degraded. Further, when the printing is to be performed in the wide region, it is necessary to repeat the printing in the small region a plurality of times, thereby increasing the printing cost.

In view of the problems described above, in the related art, there is used a printing blanket having a printing surface obtained by bonding a replaceable elastic sheet to a surface of an elastic body formed of soft silicon rubber. In the printing blanket having such a configuration, the sheet is replaceable when the printing surface is deteriorated, damaged, or affected with other external factors, and the seeping of the silicon oil from the soft silicon rubber can be suppressed.

Further, in the invention disclosed in Patent Literature 1, "a side surface of an elastic body is pressed against a sheet placed on a flat surface, to thereby manufacture a printing blanket being the elastic body having the sheet bonded to the side surface." With this, an inexpensive and replaceable sheet can be bonded to a surface of the printing blanket, onto which the printing pattern is transferred from the printing master plate. Further, when the sheet bonded to the printing blanket is deteriorated or damaged, the sheet can be released from the elastic body, and a new sheet can be bonded by the same step. Thus, the elastic body of the printing blanket can be repeatedly used.

Further, in the invention disclosed in Patent Literature 1, the sheet is bonded to the elastic body while gradually increasing the contact surface between the elastic body and the sheet from a ridge line of the elastic body to a periphery of the ridge line. Therefore, entry of air bubbles between the elastic body and the sheet is suppressed when the sheet is bonded to the surface of the elastic body.

CITATION LIST

Patent Literature

Patent Literature 1: Japanese Patent No. 5398627

SUMMARY OF INVENTION

Technical Problem

However, in the method of manufacturing a printing blanket as disclosed in Patent Literature 1, the sheet is placed on the flat surface or a concave surface, and the elastic body is pressed against the placed sheet to deform the elastic body in conformity with the shape of the placed sheet, to thereby bond the sheet to the surface of the elastic body. In this case, the deformation amount of the sheet may be smaller than the deformation amount of the elastic body. Thus, when the sheet is bonded and fixed to the elastic body pressed to be deformed, and then the pressing is stopped so that the elastic body is returned to the original shape, there is a problem in that the surface of the elastic body, which is stretched by the pressing, is returned to the original shape so that the bonded sheet is wrinkled. In particular, in the elastic body having a surface for printing with small curvature, the deformation amount of the elastic body is large when the sheet is bonded to the elastic body. Thus, the sheet is liable to be wrinkled when the elastic body is returned to the original shape.

The present invention has been made to solve the problem described above, and provides a method of manufacturing a printing blanket, which is capable of bonding a sheet to a surface of a printing blanket without wrinkles while suppressing entry of air bubbles between an elastic body of the printing blanket and the sheet, thereby obtaining a satisfactory printing surface.

Solution to Problem

According to one embodiment of the present invention, there is provided a method of manufacturing a printing blanket, the printing blanket comprising an elastic body, and a sheet bonded to a surface of the elastic body, the printing blanket being configured to press a surface of the sheet against a surface to be printed, to thereby perform printing, the method comprising: fixing the sheet at a periphery of a region of the sheet to be bonded to the elastic body; mounting the elastic body with a bonding surface of the elastic body being opposed to a bonding surface of the fixed sheet; applying an adhesive to at least one of the bonding surface of the sheet or the bonding surface of the elastic body; and pressing the bonding surface of the sheet and the bonding surface of the elastic body against each other so as to bring the sheet into close contact with the elastic body through intermediation of the adhesive while stretching the sheet along the surface of the elastic body.

Advantageous Effects of Invention

According to the present invention, when the sheet is to be bonded to the printing surface of the printing blanket, the sheet can be stretched and bonded along the surface of the elastic body. Thus, the sheet is not wrinkled even after being bonded, thereby being capable of manufacturing the printing blanket having a satisfactory printing surface. Further, when the sheet bonded to the printing surface of the printing blanket is deteriorated, damaged, or affected with other external factors, the sheet deteriorated, damaged, or affected with other external factors is released from the elastic body, and then a new sheet is bonded, thereby being capable of manufacturing the printing blanket having a satisfactory printing surface again. Thus, the elastic body of the printing blanket can be repeatedly used while securing the satisfactory printing surface, and therefore the printing cost can be reduced.

DESCRIPTION OF EMBODIMENTS

Embodiment 1

Figure 1:
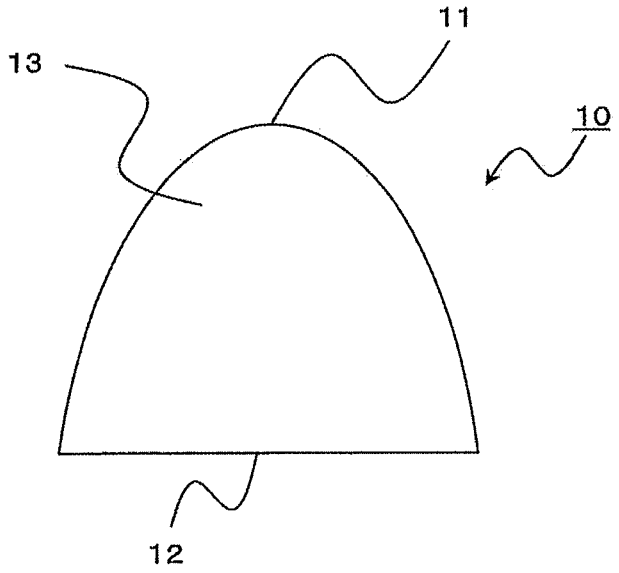
FIG. 1 is a side view for illustrating an example of a printing blanket 10 according to Embodiment 1 of the present invention.

Now, a method of manufacturing a printing blanket according to the present invention is described with reference to the drawings. Note that, the present invention is not limited to an embodiment described below. Further, in the drawings, identical parts are denoted by the same reference symbols, and description thereof is partially omitted herein. Note that, each figure is illustrated schematically, and the present invention is not limited to the illustrated forms (in particular, the thickness of the sheet is exaggerated). Further, the term "elastic body" or "elastic" as used herein is not limited to a member in a linear relationship between a load applied to the member and the amount of deformation caused by the load, but encompasses a member in a non-linear relationship, which is returned to an original state promptly or after delay of a predetermined time period when the applied load is released.

<Printing Blanket 10>

FIG. 1 is a side view for illustrating an example of a printing blanket 10 according to Embodiment 1 of the present invention. The printing blanket 10 illustrated in FIG. 1 has a substantially hemispherical shape. When the printing blanket 10 is placed so that a flat surface of the substantially hemispherical shape faces downward as a bottom surface 12, the distance from the center of the bottom surface 12 to a top 11 is larger than that of a general hemisphere having a bottom surface with the same size. That is, the printing blanket has a bullet-like shape. The shape of the blanket is not limited thereto. For example, there may be employed a hemisphere, a curved surface obtained by turning a parabola about its symmetry axis, a shape of a partially cut ellipsoid, or a shape obtained by extending a bullet shape or a semi-circular shape linearly and continuously. The shape may be changed appropriately depending on the specifications of an object to be printed or other factors. In Embodiment 1, a predetermined region including the top 11 as the center in a surface of the printing blanket 10 serves as a printing surface 13 configured such that ink is transferred from a printing master plate and transferred onto the object to be printed.

Figure 2:
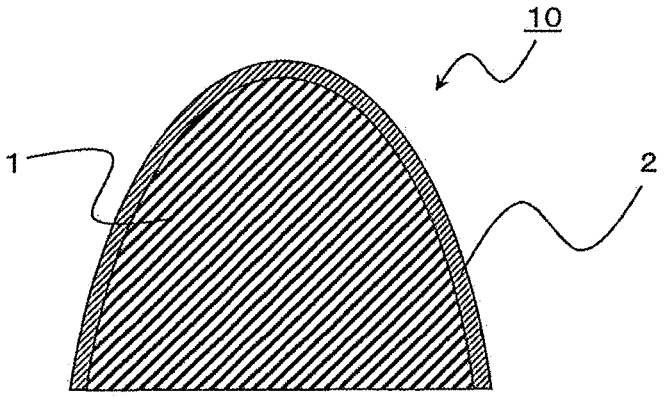
FIG. 2 is a sectional view for illustrating the printing blanket 10 in FIG. 1.

FIG. 2 is a sectional view for illustrating the printing blanket 10 in FIG. 1. The cross section that passes through the top of the printing blanket 10 and is perpendicular to the bottom surface 12 is illustrated. As illustrated in FIG. 2, the printing blanket 10 includes an elastic body 1 and a sheet 2 bonded to the elastic body 1 along a curved surface of the elastic body 1.

<Elastic Body 1>

The elastic body 1 is formed of, for example, silicon rubber. A silicon oil is mixed in the elastic body 1 so that the elastic body 1 is elastic (flexible) and easily deformable. In Embodiment 1, the elastic body 1 has a bullet shape similarly to the printing blanket 10, but the shape of the elastic body 1 may be appropriately changed depending on the specifications of the object to be printed or other factors. Note that, the material (substance) for the elastic body 1 is not limited as long as the elastic body 1 may be deformed when the elastic body 1 is pressed against the printing master plate (not shown) so that ink, which is applied to the printing master plate and corresponds to a printing pattern, is transferred to the sheet 2, and may transfer the transferred ink to the surface to be printed (not shown) when the elastic body 1 is pressed against the surface to be printed.

<Sheet 2>

The sheet 2 is formed of sheet-like silicon rubber having a predetermined thickness (for example, 0.5 mm). In Embodiment 1, for example, the silicon rubber having hardness higher than that of the silicon rubber of the elastic body 1 with a content of a silicon oil being smaller than that of the silicon rubber of the elastic body 1 is employed for the sheet 2. However, the material for the sheet 2 is not limited thereto as long as ink, which is applied to the printing master plate (not shown) and corresponds to the printing pattern, may be transferred to the sheet 2 when the sheet 2 is pressed against the printing master plate, and may transfer the transferred ink to the surface to be printed (not shown) when the sheet 2 is pressed against the surface to be printed. Further, the sheet 2 only needs to have stretchability sufficient to be bonded to the elastic body 1 along the surface of the elastic body 1 in a step of bonding the sheet 2 to the elastic body 1, which is described later.

<Functions of Elastic Body 1 and Sheet 2>

In Embodiment 1, the printing blanket 10 is pressed against the printing master plate from the top 11 to be deformed, and a predetermined region including the top 11 as the center is pressed against the printing master plate. The predetermined region is referred to as the printing surface 13. For example, the ink on the printing master plate is transferred onto the printing surface 13 of the printing blanket 10. After that, the printing surface 13 is pressed against the object to be printed, to thereby transfer the ink, which is transferred onto the printing surface 13, onto the object to be printed. The elastic body 1 is formed of silicon rubber containing a silicon oil in a large amount, thereby being easily deformed. Meanwhile, the sheet 2 bonded to the surface of the elastic body 1 is formed of, for example, silicon rubber having hardness higher than that of the elastic body 1, but the sheet 2 has a thin sheet shape so that the sheet 2 is deformable along with the deformation of the elastic body 1. However, the material for the sheet 2 is not limited only to silicon rubber having hardness higher than that of the elastic body 1, and the hardness and the material for the sheet 2 may be appropriately selected as long as the sheet 2 is deformable along with the deformation of the elastic body 1.

As described above, the printing blanket 10 is easily deformable. Thus, the printing blanket 10 is easily deformable in conformity with the surface to be printed with a curved surface shape, and is fitted to the surface to be printed satisfactorily. Further, the sheet 2 is formed of silicon rubber having hardness higher than that of the elastic body 1, and the sheet 2 is smaller in the mixing amount of a silicon oil than the elastic body 1. Thus, when the printing blanket 10 is deformed, the silicon oil mixed in the elastic body 1 is substantially sealed by the sheet 2 surrounding the elastic body 1. Further, the amount of the silicon oil mixed in the sheet 2 is small, and hence the silicon oil is less liable to seep out to the printing surface 13 formed by the sheet 2.

The printing surface 13 of the printing blanket 10 is formed by the sheet 2 having one layer, but the printing surface 13 is not limited thereto. One, two, or more layers of other sheets may be provided on the sheet 2. In this case, the printing blanket has multilayer structure of three, four, or more layers. Further, in FIG. 2, the sheet 2 entirely covers the surface of the printing blanket 10, but may partially cover the surface of the printing blanket 10.

<Method of Manufacturing Printing Blanket 10>

Figure 3:
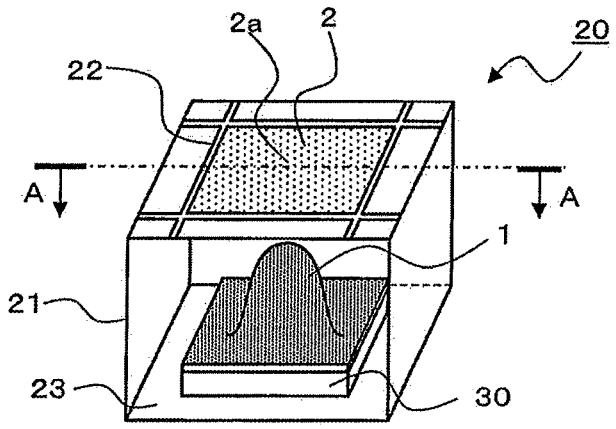
FIG. 3 is a schematic view for illustrating a bonding device 20 for a sheet 2 according to Embodiment 1.
Figure 4:
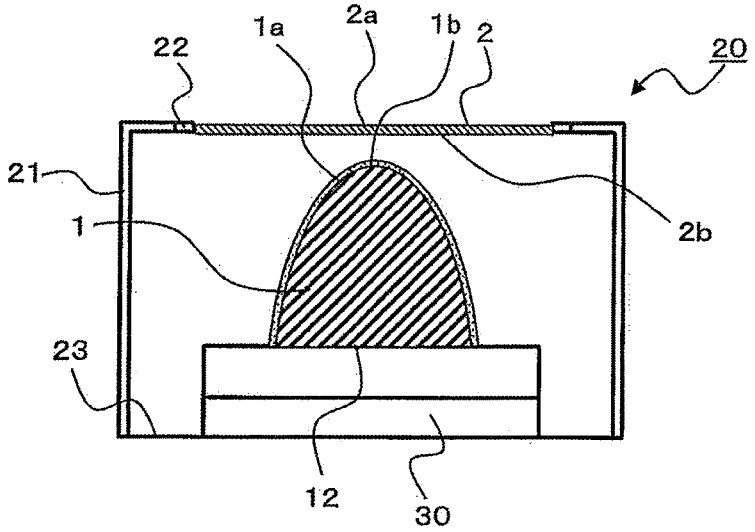
FIG. 4 is a schematic sectional view taken along the line A-A in FIG. 3, for illustrating the bonding device 20 for the sheet 2.

FIG. 3 is a schematic view for illustrating a bonding device 20 for the sheet 2 according to Embodiment 1. FIG. 4 is a schematic sectional view taken along the line A-A in FIG. 3, for illustrating the bonding device 20 for the sheet 2. Now, referring to FIG. 3 and FIG. 4, a method of manufacturing the printing blanket 10 is described.

<Step of Fixing Sheet 2>

The sheet 2 is fixed at a periphery of a region to be bonded to the elastic body 1. This step is referred to as a step of fixing a sheet. The sheet 2 is formed to have a predetermined size (thickness, length, and width). The sheet 2 having a predetermined size may be formed, or an original sheet having a large area may be cut into a predetermined rectangle (length and width).

A pedestal 21 configured to fix the sheet 2 includes a frame 22, which is arranged on an upper portion thereof, and is configured to fix the periphery of the region of the sheet 2 to be bonded to the elastic body 1 (hereinafter referred to as a bonding region 2*a*). The sheet 2 may be fixed to the frame 22 over the entire periphery of the bonding region 2*a* to be bonded to the elastic body 1, or may be fixed at a plurality of fixing portions. For example, the sheet 2 may be fixed with pins, or structure configured to fix the sheet 2 to the frame 22 by sandwiching the sheet 2 in a thickness direction may be provided so that the sheet 2 is fixed by being sandwiched with the structure. As described later, the elastic body 1 is pressed against the sheet 2 from a lower side of the pedestal 21 toward an upper side thereof. At this time, a portion of the periphery of the bonding region 2*a* of the sheet 2, which is fixed to the frame 22, is fixed so as not to be moved from the position. A tensile load is applied to the frame 22 at a portion at which the stretched sheet 2 is fixed due to an elastic force of the sheet 2, but the sheet 2 is not detached.

In FIG. 3, the frame 22 has a square shape and surrounds the bonding region 2*a*, but the frame 22 is not limited to the shape. For example, the frame 22 may have a circular shape. The shape of the frame 22 may be appropriately changed depending on the method of fixing the sheet 2, the shape of the elastic body 1, or other factors.

<Step of Mounting Elastic Body 1>

In Embodiment 1, the elastic body 1 is formed into a bullet shape. The bottom surface 12 is placed on an upper surface of a lifter 30. This step is referred to as a step of mounting an elastic body. The elastic body 1 is mounted in the pedestal 21 at a portion below the fixed sheet 2. A bonding surface 1*a* of the elastic body 1, which is configured to bond the sheet 2, is mounted so as to be opposed to a bonding surface 2*b* of the sheet 2. Further, the elastic body 1 is mounted so that the top of the bullet shape of the elastic body 1 is located at substantially the center of the bonding region 2*a* of the sheet 2.

The lifter 30 is placed on a bottom surface 23 of the pedestal 21 having a box shape. Even when the sheet 2 is pressed upward in a step of pressing described later, the distance from the bottom surface 23 to the frame 22 is not changed.

<Step of Applying Adhesive 40>

Figure 5:
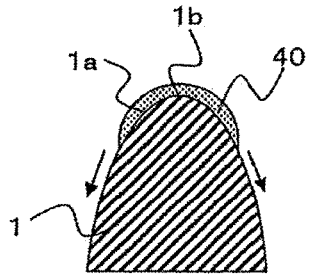
FIG. 5 is a sectional view for illustrating a state in which an adhesive 40 is placed on an elastic body 1 according to Embodiment 1.
Figure 6:
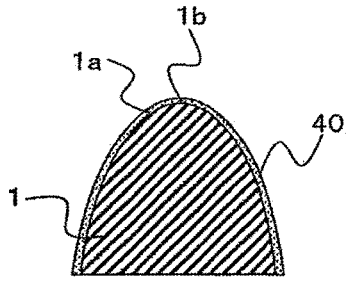
FIG. 6 is a view for illustrating a state in which the adhesive 40 is caused to flow from the state in FIG. 5.

FIG. 5 is a sectional view for illustrating a state in which an adhesive 40 is placed on the elastic body 1 according to Embodiment 1. FIG. 6 is a view for illustrating a state in which the adhesive 40 is caused to flow from the state in FIG. 5. The cross section in FIG. 5 is perpendicular to the bonding surface 2*b* of the sheet 2, and corresponds to a plane passing through the top 1*b* of the elastic body 1. The adhesive 40 is placed in the vicinity of the top 1*b* of the elastic body 1. The placed adhesive 40 is caused to flow downward along the surface of the elastic body 1 due to the gravity, that is, is caused to flow in a direction indicated by the arrows of FIG. 5. With this, as illustrated in FIG. 6, the adhesive 40 is spread thinly on the bonding surface 1*a* of the elastic body 1. The adhesive 40 is spread due to the gravity so that the adhesive 40 can be spread evenly on the surface of the elastic body 1, thereby obtaining an advantage in that an adverse effect, such as entry of air bubbles in the adhesive 40, is less liable to be caused. This step is referred to as a step of applying an adhesive.

The adhesive 40 is applied as described above, thereby being capable of suppressing a transfer failure of ink from the printing master plate or a transfer failure of ink onto the object to be printed when the air bubbles enter a portion between the sheet 2 and the elastic body 1 of the printing blanket 10. When the sheet 2 is bonded to the elastic body 1 under the state in which the air bubbles enter the adhesive 40, the air bubbles are liable to enter a portion between the sheet 2 and the elastic body 1. Thus, when the printing blanket 10 is pressed against the printing master plate, the ink may not be easily transferred onto the portion of the sheet 2, at which the air bubbles are present. Further, there arises a problem in that, when the printing blanket 10 is pressed against the object to be printed, the ink may not be easily transferred onto the object to be printed.

The adhesive 40 does not necessarily need to be spread thinly on the surface of the elastic body 1 as in the state in FIG. 5. When the viscosity of the adhesive 40 is high (hard), the sheet 2 can be bonded even under a state in which the adhesive 40 is not spread from the state in FIG. 5. The reason is as follows. A speed at which the elastic body 1 is pressed against the sheet 2 is set to be lowered in the step of pressing the elastic body 1 against the sheet 2, which is described later, so that the adhesive 40 can be spread gradually downward from the top 1*b*, thereby obtaining the same effect as that in the case where the adhesive 40 is spread due to the gravity.

It is desired that the air bubbles entering the adhesive 40 be removed from the adhesive 40 before the step of applying an adhesive. This step is referred to as a step of removing air bubbles. Through this step, the entry of the air bubbles between the sheet 2 and the elastic body 1 can be further suppressed.

<Step of Pressing>

Figure 7:
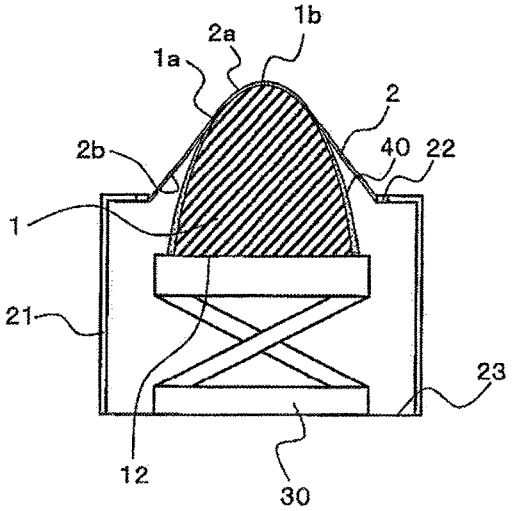
FIG. 7 is a view for illustrating a state in which the elastic body 1 is pressed against the sheet 2 from the state in FIG. 4.

FIG. 7 is a view for illustrating a state in which the elastic body 1 is pressed against the sheet 2 from the state in FIG. 4. The lifter 30 is vertically stretchable so that the lifter 30 can vertically move the elastic body 1. This step is referred to as a step of moving. The bonding surface 1*a* of the elastic body 1, to which the adhesive 40 is applied, is pressed against the bonding surface 2*b* of the sheet 2 by the lifter 30. The sheet 2 against which the elastic body 1 is pressed has stretchability. Thus, the sheet 2 is brought into close contact with the elastic body 1 along the shape of the surface of the elastic body 1 while being stretched upward along with the upward movement of the elastic body 1. Along with the close contact of the sheet 2 with the elastic body 1 along the shape of the elastic body 1, the adhesive 40 applied to the bonding surface 1*a* is compressed by the elastic body 1 and the sheet 2 so that the adhesive 40 is further spread thinly on the surface of the elastic body 1.

First, the top 1*b* of the elastic body 1 is brought into contact (point-contact) with the sheet 2. Subsequently, the sheet 2 is deformed along with the pressing so that the contact position is moved gradually in a direction away from the top 1*b*, thereby increasing the contact area. Therefore, intrusion of air at the contact surface between the sheet 2 and the elastic body 1 is suppressed. Though this step, the sheet 2 is brought into close contact with the bonding surface 1*a* of the elastic body 1 sufficiently through intermediation of the adhesive 40. The step described above is referred to as the step of pressing. The step of moving is included in the step of pressing.

A speed at which the elastic body 1 is moved upward in the step of moving is set to such an extent that the air bubbles do not enter a portion between the sheet 2 and the adhesive 40. This speed only needs to be appropriately set depending on the amount of the adhesive 40, the viscosity of the adhesive 40, the hardness of the material for the sheet 2, the hardness of the elastic body 1, and other factors.

<Step of Holding Sheet 2>

When the sheet 2 is brought into close contact with the bonding surface 1*a* of the elastic body 1 sufficiently through intermediation of the adhesive 40, the close-contact state is kept. For example, the sheet bonding device 20 is kept under the state as it is. Note that, when the sheet 2 is to be held on the bonding surface 1*a* of the elastic body 1 through intermediation of the adhesive 40 under the close-contact state, the present invention is not limited to the method of keeping the sheet bonding device 20 under the state as it is. For example, the sheet 2 may be fixed with push pins or by other measures so that the sheet 2 can be held under the state in which the sheet 2 is brought into close contact with the bonding surface 1*a* of the elastic body 1. Then, the elastic body 1 having the sheet 2 brought into close contact therewith may be removed from the sheet bonding device 20, and the elastic body 1 may be left until the adhesive 40 is cured. Further, for example, a pressure-sensitive adhesive tape or other measures may be employed instead of the push pins configured to fix the sheet 2. The step described above is referred to as a step of holding a sheet.

<Replacement of Sheet 2>

Through repetition of the printing, the printing surface 13 of the printing blanket 10 (surface to which the ink is transferred from the printing master plate, and from which the ink is transferred by being pressed against the surface to be printed) is deteriorated or damaged. With the above-mentioned series of the steps in the method of manufacturing the printing blanket 10, a new sheet 2 can be bonded to the elastic body 1 from which the deteriorated sheet 2 is released. With this, the elastic body 1 can be used repeatedly by replacing the sheet 2, thereby being capable of continuing satisfactory printing at low cost. In order to facilitate the releasing of the deteriorated sheet 2, a release agent may be applied to the surface of the elastic body 1. When a covering member having an inner surface with the same shape as that of the surface of the elastic body 1 and having a predetermined thickness is to be formed using a die instead of the sheet 2, the die needs to be manufactured for each shape of the elastic body 1. Thus, there may arise a problem of increase in manufacturing cost for the printing blanket, and a further problem of degradation in printing quality due to intrusion of the air between the inner surface of the covering member and the elastic body 1 when the covering member is bonded to the elastic body 1. However, through the employment of the method of manufacturing the printing blanket 10 according to Embodiment 1, advantages of not only reducing the cost for the printing blanket 10 but also securing the quality are obtained.

<Positional Relationship Between Elastic Body 1 and Sheet 2>

In the above-mentioned method of manufacturing the printing blanket 10, the positional relationship between the elastic body 1 and the sheet 2 is not limited only to the positional relationship in Embodiment 1, and, for example, the vertical relationship may be reversed. Further, the positional relationship between the elastic body 1 and the sheet 2 may be appropriately set depending on the shape of the elastic body 1, a position at which the sheet 2 is bonded, or other factors. For example, when the elastic body 1 is pressed from above, the sheet 2 is, for example, fixed to the pedestal 21, and the adhesive 40 is placed on the sheet 2. The adhesive 40 is placed on a region including a position at which the sheet 2 and the top 1*b* of the elastic body 1 are to be held in contact with each other, and the elastic body 1 is pressed against the adhesive 40 placed on the region from above. The elastic body 1 is mounted to a device linearly movable vertically, such as a hand press, which is installed above the pedestal 21, so that the elastic body 1 is movable vertically. The elastic body 1 is moved downward to be pressed against the sheet 2 so that the sheet 2 is stretched downward with its periphery being fixed as it is. Along with the stretching of the sheet 2, the adhesive 40 is also pressed to be spread along the shape of the elastic body 1. With this, the sheet 2 is stretched and brought into close contact with the elastic body 1 along the shape of the elastic body 1 while the adhesive 40 is thinly spread between the sheet 2 and the elastic body 1, thereby obtaining the same effect as in the case where the elastic body 1 is pressed against the sheet 2 from below the sheet 2.

<Lifter 30>

Further, in FIG. 7, the lifter 30 is capable of vertically moving, with a link, a base configured to place the elastic body 1, but the lifter 30 is not limited to this structure. For example, the lifter 30 only needs to have structure linearly movable so as to vertically guide the base, such as a jack or the hand press. Power for vertically driving the lifter 30 and other components may be electrical or manual, and the power is not particularly limited as long as the lifter 30 and other components can be moved at a predetermined speed. Further, in Embodiment 1, the elastic body 1 is moved upward by the lifter 30, but the frame 22 to which the sheet 2 is fixed may be moved toward the elastic body 1 so that the bonding surface 1*a* of the elastic body 1 is pressed against the bonding surface 2*b* of the sheet 2. Alternatively, the pedestal 21 including the frame 22 may be vertically moved so that the sheet 2 is moved toward the elastic body 1.

Effects of the Present Invention

The method of manufacturing the printing blanket 10 according to the present invention corresponds to a method of manufacturing the printing blanket 10 including the elastic body 1 and the sheet 2 bonded to the surface of the elastic body 1, which is configured to press the surface of the sheet 2 against the surface to be printed so as to perform printing. The method of manufacturing the printing blanket 10 according to the present invention includes the step of fixing the sheet 2 at the periphery of the region of the sheet 2 to be bonded to the elastic body 1, the step of mounting the elastic body 1 so that the bonding surface 1*a* of the elastic body 1 is opposed to the bonding surface 2*b* of the fixed sheet 2, the step of applying the adhesive 40 to at least one of the bonding surface 2*b* of the sheet 2 or the bonding surface 1*a* of the elastic body 1, and the step of pressing the bonding surface 2*b* of the sheet 2 and the bonding surface 1*a* of the elastic body 1 against each other so as to bring the sheet 2 into close contact with the elastic body 1 through intermediation of the adhesive 40 while stretching the sheet 2 along the surface of the elastic body 1. With this configuration, the entry of the air bubbles between the elastic body 1 and the sheet 2 can be suppressed so that the printing blanket 10 can have a satisfactory printing surface. With the printing surface of the printing blanket 10 without the air bubbles, a void of ink (partial void) is eliminated from the surface to be printed, thereby being capable of performing printing satisfactorily.

Further, the sheet 2 to be bonded to the elastic body 1 is brought into close contact with the elastic body 1 while stretching the sheet 2 along the shape of the elastic body 1, and is bonded to the elastic body 1 under a state in which the deformation amount of the shape of the elastic body 1 is small. Therefore, the sheet 2 is not wrinkled at the completion of the printing blanket 10, thereby being capable of easily obtaining the printing blanket 10 having a satisfactory printing surface. Further, even when the surface of the printing blanket 10 is deteriorated or damaged, the new sheet 2 can be bonded again with high quality by the manufacturing method. Thus, the cost for the printing blanket 10 can be reduced, and therefore, the cost for the printing can be reduced. When the release agent or other agents are applied to the elastic body 1 before applying the adhesive 40 in order to facilitate the releasing of the sheet 2 from the surface of the elastic body 1, the sheet 2 can be removed further easily.

Further, in the method of manufacturing the printing blanket 10 according to the present invention, the step of fixing a sheet further includes fixing the sheet 2 to the frame surrounding the entire periphery of the region of the sheet 2 to be bonded to the elastic body 1. With this configuration, the periphery of the sheet 2 can be fixed securely. Through the fixing of the entire periphery of the sheet 2 to the frame 22, when the elastic body 1 is pressed against the sheet 2 to stretch the sheet 2, the sheet 2 can be stretched evenly. Thus, the sheet 2 is further less liable to be wrinkled at the completion of the printing blanket 10.

Further, in the method of manufacturing the printing blanket 10 according to the present invention, the step of mounting an elastic body includes mounting the elastic body 1 so that the bonding surface 2*b* of the sheet 2 and the bonding surface 1*a* of the elastic body 1 are vertically opposed to each other. With this configuration, the elastic body 1 is not deformed due to the gravity, thereby being capable of bonding the sheet 2 to the elastic body 1 with high quality. Further, the adhesive 40 applied to the surface of the elastic body 1 or the adhesive 40 placed on the sheet 2 is not spread unevenly due to the gravity, thereby also being capable of securing the bonding state of the sheet 2 satisfactorily.

Further, in the method of manufacturing the printing blanket 10 according to the present invention, the step of mounting an elastic body includes mounting the elastic body 1 so that the bonding surface 1*a* of the elastic body faces upward. The step of applying an adhesive includes placing the adhesive 40 on the upper portion of the elastic body 1 to cause the adhesive 40 to flow in a direction in which the gravity acts, to thereby apply the adhesive 40 to the surface of the elastic body 1. With this configuration, the adhesive 40 can be caused to flow due to the gravity, thereby being capable of applying the adhesive 40 evenly on the surface of the elastic body 1. Further, even when the viscosity of the adhesive 40 is high so that the adhesive 40 is less easily caused to flow, the elastic body 1 is pressed against the sheet 2 so that the adhesive 40 is moved in the gravity direction, thereby being capable of easily spreading the adhesive 40.

Further, in the method of manufacturing the printing blanket 10 according to the present invention, the step of pressing further includes the step of moving at least one of the elastic body 1 or the sheet 2 by the moving unit linearly movable vertically. With this configuration, the elastic body 1 or the sheet 2 can be moved vertically at a predetermined speed with high accuracy, thereby being capable of spreading the adhesive 40 evenly. Further, the entry of the air bubbles between the elastic body 1 and the sheet 2 can be prevented, thereby being capable of obtaining the printing blanket 10 having a satisfactory printing surface.

Further, the method of manufacturing the printing blanket 10 according to the present invention includes, before the step of applying an adhesive, the step of removing the air bubbles contained in the adhesive 40. With this configuration, the air bubbles contained in the adhesive 40 can be removed in advance. Thus, the entry of the air bubbles between the elastic body 1 and the sheet 2 can be further prevented, thereby being capable of obtaining the printing blanket 10 having a satisfactory printing surface.

REFERENCE SIGNS LIST

1 elastic body 1*a* bonding surface 1*b* top 2 sheet 2*a* bonding region 2*b* bonding surface 10 printing blanket 11 top 12 bottom surface 13 printing surface 20 sheet bonding device 21 pedestal 22 frame 23 bottom surface 30 lifter 40 adhesive

The invention claimed is:

1. A method of manufacturing a printing blanket, the printing blanket comprising an elastic body, and a sheet bonded to a surface of the elastic body, the printing blanket being configured to press a surface of the sheet against a surface to be printed, to thereby perform printing, the method comprising:

fixing the sheet at a periphery of a region of the sheet to be bonded to the elastic body;

mounting the elastic body with a bonding surface of the elastic body being opposed to a bonding surface of the fixed sheet;

applying an adhesive to at least one of the bonding surface of the sheet and the bonding surface of the elastic body; and pressing the bonding surface of the sheet and the bonding surface of the elastic body against each other so as to bring the sheet into close contact with the elastic body through intermediation of the adhesive while stretching the sheet along the surface of the elastic body.

2. The method of manufacturing a printing blanket of claim 1, wherein the step of fixing the sheet comprises fixing the sheet to a frame surrounding an entire periphery of a bonding region of the sheet to be bonded to the elastic body.

3. The method of manufacturing a printing blanket of claim 1, wherein the step of mounting the elastic body comprises mounting the elastic body with the bonding surface of the sheet and the bonding surface of the elastic body being vertically opposed to each other.

4. The method of manufacturing a printing blanket of claim 3, wherein the step of mounting the elastic body comprises mounting the elastic body with the bonding surface of the elastic body facing upward, and the step of applying the adhesive comprises placing the adhesive on an upper portion of the elastic body to cause the adhesive to flow in a direction in which gravity acts, to thereby apply the adhesive to the surface of the elastic body.

5. The method of manufacturing a printing blanket of claim 3, wherein the step of pressing comprises moving at least one of the elastic body and the sheet by a moving unit linearly movable vertically.

6. The method of manufacturing a printing blanket of claim 1, further comprising removing air bubbles contained in the adhesive before the step of applying the adhesive.

* * * * *